US005301394A

United States Patent [19]

Richardson et al.

[11] Patent Number: 5,301,394

[45] Date of Patent: Apr. 12, 1994

[54] PLASTIC RECLOSABLE FASTENER WITH SLIDER DETENT LOCK FOR LOCKING SLIDER IN CLOSED POSITION

[75] Inventors: Dale S. Richardson, Westerville; Roger W. Smith, Grove City, both of Ohio

[73] Assignee: Mobil Oil Corporation, Fairfax, Va.

[21] Appl. No.: 98,982

[22] Filed: Jul. 29, 1993

[51] Int. Cl.[5] ..... A44B 19/16

[52] U.S. Cl. ..... 24/399; 24/400; 24/416; 24/417; 24/427

[58] Field of Search ..... 24/387, 388, 389, 390, 24/399, 400, 402, 415, 416, 417, 418, 427, 428, 433, 436, 587; 383/63, 64, 65, 69

[56] References Cited

U.S. PATENT DOCUMENTS

| | | | |
|---|---|---|---|
| 2,070,753 | 2/1937 | Schatzky | 24/417 |
| 2,193,757 | 3/1940 | Beckwith | 24/417 |
| 2,997,765 | 8/1961 | Markoff-Moghadam | 24/400 |
| 3,115,689 | 12/1963 | Jacobs | 24/399 |
| 3,234,614 | 2/1966 | Plummer | 24/427 X |
| 3,713,923 | 1/1973 | Lagnerre | 24/427 X |

FOREIGN PATENT DOCUMENTS

| | | | |
|---|---|---|---|
| 203680 | 6/1939 | Switzerland | 24/416 |

*Primary Examiner*—Laurie K. Cranmer

*Attorney, Agent, or Firm*—Alexander J. McKillop; George W. Hager, Jr.

[57] ABSTRACT

A plastic reclosable fastener or zipper with slider detent lock for locking the slider in closed position on plastic-film bags and the like is disclosed. The slider includes two spring-loaded detent elements located on opposite sides of the separator finger on the slider. When the slider is at any location other than the fully closed position at the end of the fastener, the spring-loaded detent elements ride against the outside surfaces of the flanges by which the separator finger opens the fastener. When the slider reaches the location at the end of the fastener where portions of the flanges have been removed to provide a notch, the spring-loaded detent elements spring inward against the sides of the separator finger. There they resist an attempt to move the slider in an opening direction because this requires that they be forced outward over the flanges of the zipper.

3 Claims, 2 Drawing Sheets

PLASTIC RECLOSABLE FASTENER WITH SLIDER DETENT LOCK FOR LOCKING SLIDER IN CLOSED POSITION

BACKGROUND OF THE INVENTION

The present invention relates to improvements in plastic reclosable fasteners or zippers with sliders for opening and closing the reclosable fasteners on plastic-film bags and the like and particularly to a detent lock structure for locking the slider in closed position when the slider reaches the fully closed position at the end of its travel along the reclosable fastener.

Plastic zippers with sliders are well known in the art. The plastic zippers have a pair of male and female fastener elements in the form of reclosable interlocking rib and groove elements with a slider having separator structure for opening and closing the rib and groove elements. In the manufacture of plastic-film bags, a pair of these male and female fastener elements extend along the mouth of the bags and these male and female elements are secured in any suitable manner to the flexible walls of the bags. These elements may be integral marginal portions of such walls or they may be extruded separately and thereafter attached to the walls along the mouth of the bag. It frequently is desirable that the plastic-film bags be leakproof. One example of a plastic-film bag having a slider and flexible closure strips adapted to be joined by such slider to form an air-tight closure is disclosed in U.S. Pat. No. 3,259,951—Zimmermann. Another example of a plastic-film bag with a leakproof zipper and slider is disclosed in U.S. Pat. No. 5,020,194—Herrington et al. For leakproof plastic-film bags it also is desirable that the bags include a detent structure for retaining the slider in closed position. Examples of this type construction are disclosed in U.S. Pat. No. —5,067,208 Herrington et al and U.S. Pat. No. 5,189,764—Herrington et al.

Another example of a detent structure is disclosed in our copending patent application entitled "Plastic Reclosable Fastener with Structure for Restraining Slider in Closed Position and for Facilitating Reopening the Fastener" Ser. No. 08/098983, filed Jul. 29, 1993.

It would be desirable to provide a plastic-film bag with a zipper that is operated by a slider wherein a detent lock using spring-loaded elements is provided on the slider to lock the slider in closed position when the slider reaches the fully closed position at the end of its travel along the zipper.

SUMMARY OF THE INVENTION

It is an object of the present invention to provide a plastic-film bag with a zipper that is operated by a slider wherein a detent lock using spring-loaded elements is provided on the slider to lock the slider in closed position when the slider reaches the fully closed position at the end of its travel along the zipper.

The present invention relates to a plastic reclosable fastener with slider particularly suited for plastic-film bags and the like for closing or opening the reclosable fastener or zipper and for locking the slider in closed position when the slider reaches the fully closed position at the end of its travel along the fastener. The reclosable fastener comprises a pair of flexible plastic strips having separable fastener means extending along the length thereof comprising reclosable interlocking male and female profile elements on the respective strips. The strips include flanges extending along the length thereof parallel to the male and female elements. A straddling slider is positioned on the strips for moving along the fastener in straddling relation to open or close the reclosable interlocking male and female elements. The slider comprises an inverted substantially U-shaped plastic member for moving along the top edges of the fastener with depending sidewalls that comprise the two legs of the U maintaining the flanges and the male and female elements therebetween and a support member that comprises the base of the U. The sidewalls extend from an opening end of the slider to a closing end, the sidewalls being spaced wider apart at the opening end to permit separation of the male and female elements and being spaced sufficiently close together at the closing end to press the male and female elements into interlocking relationship as the slider is moved in a fastener-closing direction. The slider includes separator structure depending from the support member and inserted between the flanges to open the male and female elements. The separator structure is located at the opening end of the slider. Notched structure is located at the end of the flanges to receive the separator structure when the reclosable fastener is in closed condition. Detent lock structure is carried by the slider for engaging the separator structure when the separator structure is received in the notched structure and for thereby locking the slider in closed position and maintaining the male and female elements in interlocking relation when the slider reaches the fully closed position at the end of its travel along the fastener.

Other objects and advantages of the invention will become apparent from the following detailed description of the invention taken in conjunction with the accompanying drawings.

DESCRIPTION OF THE PREFERRED EMBODIMENT

Figure 1:
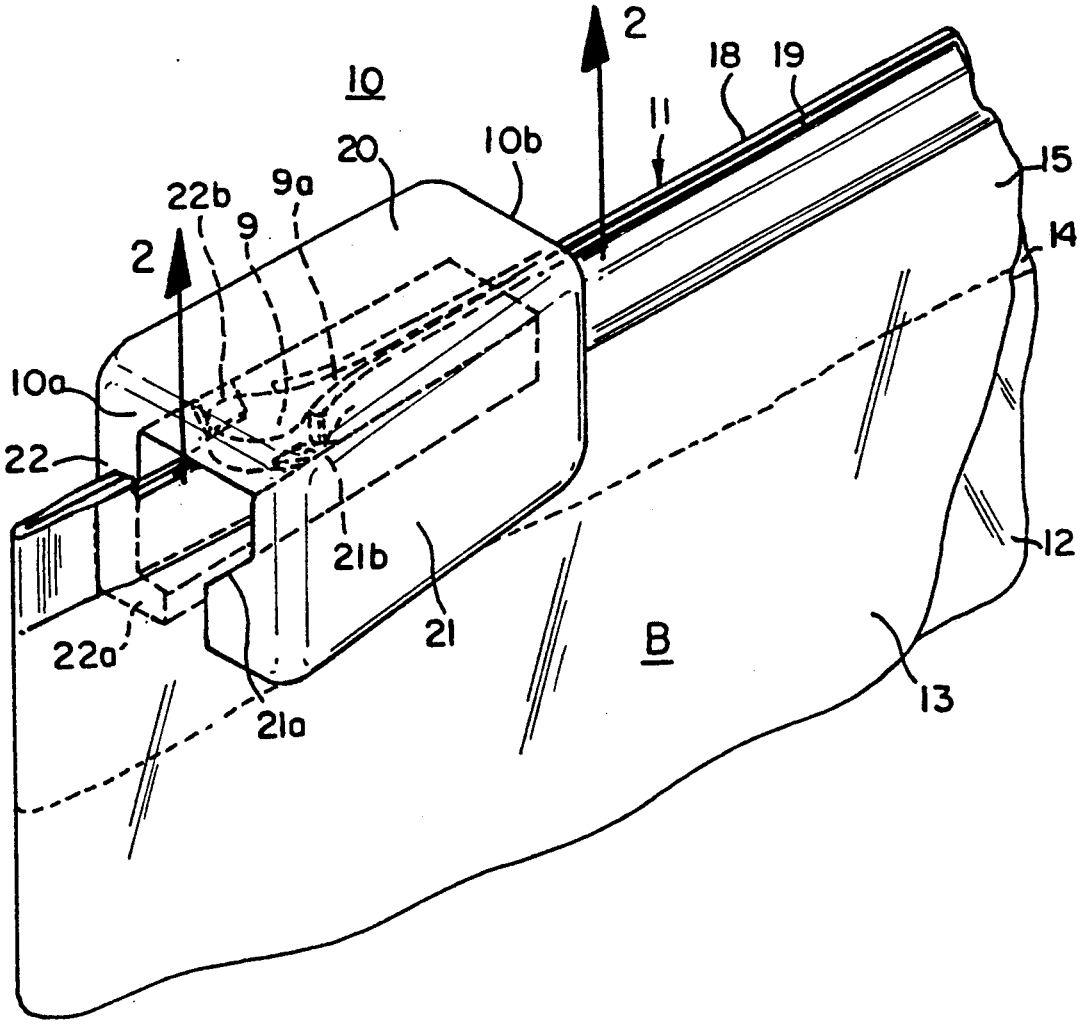
FIG. 1 is a fractional perspective view of a plastic-film bag with a plastic reclosable fastener and slider constructed in accordance with the present invention with the slider in its fully closed position at the end of the fastener.
Figure 3:
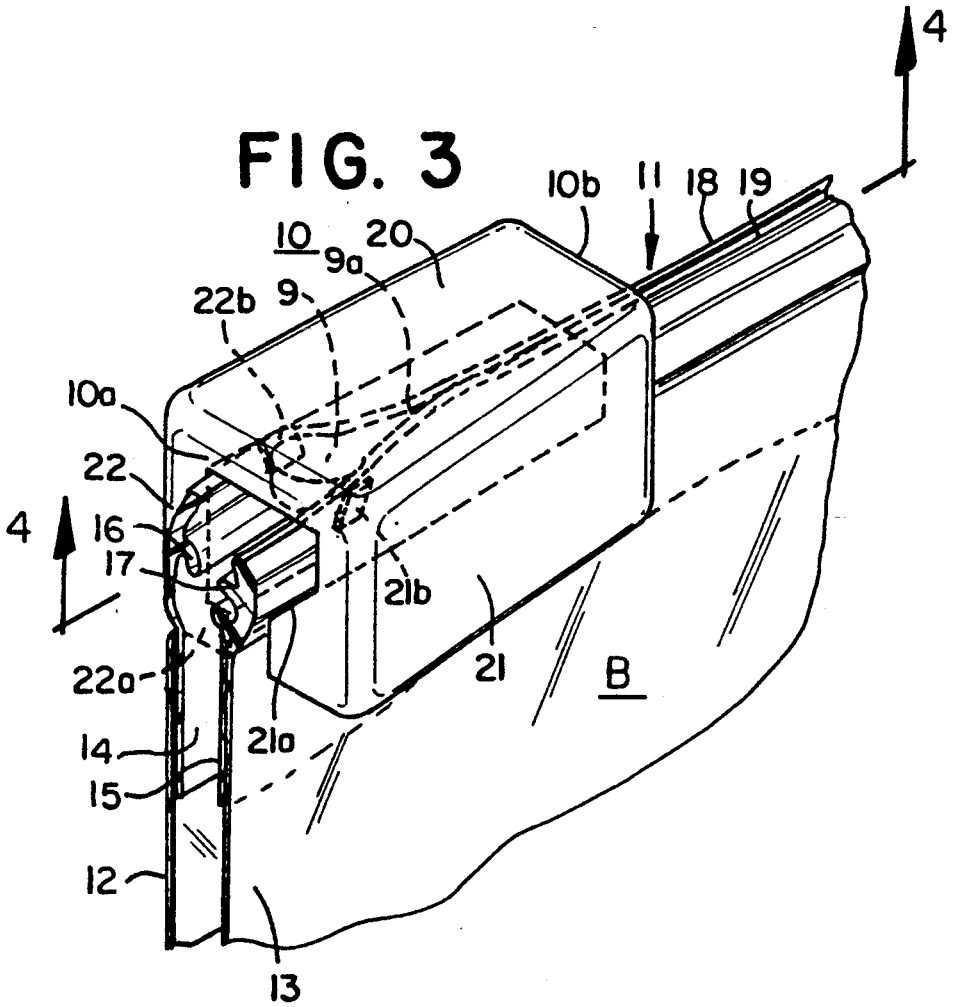
FIG. 3 is a fractional perspective view of the present invention similar to FIG. 1 and showing the slider moved to a partially open position on the reclosable fastener.

Referring to FIGS. 1 and 3 there is illustrated a plastic slider 10 and a profiled plastic reclosable fastener or zipper 11 embodying the present invention. The slider 10 and zipper 11 are particularly suited for plastic-film bags and the like and the slider 10 has been illustrated in FIGS. 1 and 3 assembled on the zipper 11 at the top edge or mouth of the plastic-film bag B. The bag B may be made from any suitable plastic-film such for example as polyethylene, polypropylene or similar material. The bag B is formed by a pair of flexible plastic sheets 12 and 13 joined at the bottom and having a top edge or mouth, with a pair of flexible plastic strips 14 and 15 having separable plastic means extending along the length thereof comprising reclosable interlocking male and female profile elements in the form of rib and groove fastener elements 16 and 17, FIG. 3, on the respective strips to form the zipper 11. The strips 14 and 15 may be extruded separately and attached to the separate sides of the bag mouth or the strips 14 and 15 may be extruded integral with the sides of the bag mouth. The strips 14 and 15 include flanges 18 and 19 extending along the length thereof parallel to the rib and groove fastener elements 16 and 17 and the rib and groove fastener elements 16 and 17 have complementary cross-sectional shapes such that they may be closed by pressing the elements together by means of the slider 10. The cross-sectional shapes of the interlocking male and female fastener elements having rib and groove profiles 16 and 17 may be of any suitable type. One example of a suitable type is disclosed in the aforesaid U.S. Pat. No. 5,067,208.

It is to be understood that the present invention is not limited to the shapes of the rib and groove profiles illustrated herein and that other shapes may be utilized in connection with the present invention. It also is to be understood that the present invention is not limited t the particular construction of the slider 10 disclosed herein except as defined in the appended claims and that other zipper sliders may be utilized in connection with the present invention and particularly the manner of assembly of the sliders with the zipper.

As may be seen in FIGS. 1 and 3 the slider 10 straddles the zipper 11 at the top of the bag B and is adapted for opening or closing the reclosable fastener elements 16 or 17, shown in FIG. 3, of the zipper 11. For purposes of explanation, the slider 10 has been illustrated in simplified form and only the structure which particularly relates to the present invention will be described in detail. In general, the slider 10 may be of similar construction to the slider disclosed in the aforesaid U.S. Pat. No. 5,067,208 except for the construction of the locking structure which cooperates with the separator finger 9 as hereinafter described in detail. The slider 10 preferably is formed from a single piece of molded plastic comprising a substantially U-shaped plastic member for supporting the separator finger 9 and moving it along the zipper 11. The slider 10 may be molded from any suitable plastic such for example as nylon, polypropylene, polyethylene, polystyrene, Delrin, or ABS.

Referring to FIG. 1, it will be seen that the slider 10 comprises an inverted U-shaped member including a transverse support member 20 from which the separator finger 9 depends. The slider includes two depending sidewalls 21 and 22. The separator finger 9 preferably is cylindrical at one end and pointed at the other end **9*a* and is positioned between the sidewalls 21 and 22. The slider is adapted to move along the top edges of the strips 14 and 15 with the sidewalls 20 and 21 straddling the fastener elements 16 and 17 and the separator finger 9 positioned between the flanges 18 and 19 as shown in FIG. 3. As may be seen in FIG. 3 the bottoms of the sidewalls 21 and 22 are provided with inwardly extending shoulders 21*a* and 22*a* which are positioned beneath the bottom of the fastener elements 16 and 17 of the zipper 11 to prevent the slider 10 from being lifted off the zipper 11. The depending sidewalls 21 and 22 extend from an opening end 10*a* of the slider 10 to a closing end 10*b*. It Will be noted that the separator finger 9 is supported by support member 20 at the opening end 10*a* of the slider 10. The sidewalls 21 and 22 are spaced wider apart at the opening end 10*a* of the slider to permit the separation of the rib and groove fastener elements 16 and 17 by the separator finger 9 engaging the flanges 18 and 19 and are spaced sufficiently close together at the closing end 10*b* of the slider to press the rib and groove fastener elements 16 and 17 into interlocking relationship as the slider is moved in a fastener-closing direction from the position shown in FIG. 3 to the fully closed position shown in FIG. 1**.

In accordance with the present invention there is provided means for locking the slider 10 in the fully closed position and thereby maintaining the male and female elements of the zipper in interlocking relation when the slider 10 reaches the fully closed position at the end of its travel along the strips 14 and 15 as shown in FIG. 1. It will be noted in FIG. 1 that the flanges 18 and 19 are notched to receive the cylindrical end of the separator finger 9 when the reclosable fastener 11 is in closed condition. This is clearly shown in FIGS. 1 and 2. As may be seen in FIGS. 1 and 2 the separator finger 9 includes a cylindrical portion and a pointed or narrower portion **9*a* which remains between the flanges 18 and 19 of the zipper when the separator finger 9 of the slider is within the notch of the flanges at the end of the zipper. The separator finger 9 is similar to the separator finger disclosed in the aforesaid U.S. Pat. No. 5,067,208 and the narrow section 9*a*** of the separator finger facilitates re-entry of the cylindrical portion of the separator finger back between the flanges of the zipper.

Figure 2:
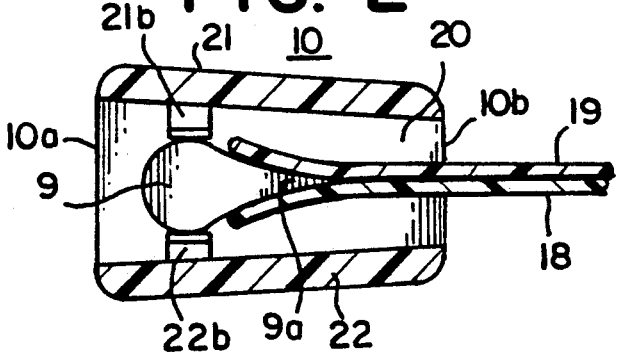
FIG. 2 is a sectional view taken along the lines 2—2 in FIG. 1.
Figure 4:
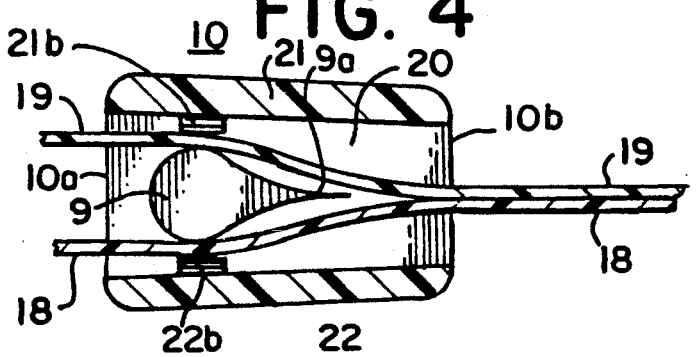
FIG. 4 is a sectional view taken along the lines 4—4 in FIG. 3.

In the present invention the slider 10 is provided with two detent elements **21*b* and 22*b* located on opposite sides of the separator finger 9 which are spring loaded toward it. When the slider 10 is at any location along the zipper 11 other than the fully closed position at the end of the fastener, as shown in FIGS. 3 and 4, the spring-loaded detent elements 21*b* and 22*b* ride against the outside surfaces of the flanges 18 and 19 respectively. When the slider 10 reaches the fully closed position at the closed end of the fastener, and the separator finger 9 is within the notch where the flanges 18 and 19 have been removed, as shown in FIGS. 1 and 2, the detent elements 21*b* and 22*b* spring inward against the sides of the separator finger 9. There detent elements 21*b* and 22*b* resist an attempt to move the slider 10 in the bag-opening direction because this requires that they be forced back over the flanges 18 and 19. The force required to overcome this detent locking action will be determined by the spring force of the detent elements 21*b*, 22*b* and the geometry of the separator finger 9. In the embodiment of the invention illustrated in FIGS. 1–4, the spring-loaded detent elements 21*b*, 22*b* are molded as part of the sidewalls 21 and 22** from which they project. This type of construction can be utilized where the slider includes hinged sidewalls or where the sidewalls are separate elements.

While the present invention for locking the slider in closed position has been illustrated in connection with a separator finger of the particular shape disclosed herein, it is to be understood that the present invention also is applicable to sliders having separator fingers of the type disclosed in the aforesaid U.S. Pat. No. 5,067,208 and also to sliders having a separator finger of cylindrical shape as disclosed in our aforesaid copending application Ser. No. 08/098983 filed concurrently herewith and assigned to the same assignee.

While a preferred embodiment of the invention has been described and illustrated, it is to be understood that further modifications thereof may be made within the scope of the invention without departing from the spirit of the invention.

What is claimed is:

1. A plastic reclosable fastener with slider particularly suited for plastic-film bags and the like for closing or opening the reclosable fastener, said reclosable fastener comprising a pair of flexible plastic strips having separable fastener means extending along the length thereof comprising reclosable interlocking male and female profile elements on the respective strips, said strips including flanges extending along the length thereof parallel to said male and female elements, a straddling slider on said strips for moving along the fastener in straddling relation to open or close the reclosable interlocking male and female elements, said slider comprising an inverted substantially U-shaped plastic member for moving along the top edges of said fastener with depending sidewalls that comprise the two legs of the for maintaining said flanges and said male and female elements therebetween and a support member that comprises the base of the U, said sidewalls extend from an opening end of the slider to a closing end, the sidewalls being spaced wider apart at the opening end to permit separation of the male and female elements and being spaced sufficiently close together at the closing end to press the male and female elements into interlocking relationship as the slider is moved in a fastener-closing direction, said slider including separator structure depending from said support member and inserted between said flanges to open said male and female elements, said separator structure being located at said opening end of said slider, notched structure at the end of said flanges adapted to receive said separator structure when said reclosable fastener is in closed condition, and detent lock structure carried by said slider for engaging said separator structure when said separator structure is received in said notched structure and for restraining said slider in fully closed position and thereby maintaining said male and female elements in interlocking relation when said slider reaches the fully closed position at the end of its travel along said fastener.

2. A plastic reclosable fastener with slider according to claim 1 wherein said detent lock structure comprises a pair of spring-loaded elements located on opposite sides of said separator structure and spring loaded toward said separator structure.

3. A plastic reclosable fastener with slider according to claim 2 wherein said pair of spring-loaded elements are molded integral with said slider.

* * * * *